United States Patent [19]

Buhrow

[11] Patent Number: 5,056,795

[45] Date of Patent: Oct. 15, 1991

[54] RECREATIONAL DEVICE AND METHODS OF USING SAME

[76] Inventor: Gerald L. Buhrow, 6910 N. 79th St., Scottsdale, Ariz. 85250

[21] Appl. No.: 523,219

[22] Filed: May 14, 1990

[51] Int. Cl.[5] ..... A63B 67/00

[52] U.S. Cl. ..... 273/400; 273/415

[58] Field of Search ..... 273/400, 401, 415, 424, 273/425, 428, 336, 341, 411

[56] References Cited

U.S. PATENT DOCUMENTS

| | | | |
|---|---|---|---|
| 922,717 | 5/1909 | Parker | 273/401 |
| 1,230,503 | 6/1917 | Miller | 273/336 |
| 2,321,278 | 6/1943 | Boulanger | 273/411 X |
| 2,640,699 | 6/1953 | Garbo | 273/424 |
| 3,467,388 | 9/1969 | Weiler | 273/400 X |
| 3,948,521 | 4/1976 | Warren | 273/411 X |
| 3,957,270 | 5/1976 | Fekete | 273/341 |

*Primary Examiner*—William H. Grieb

*Attorney, Agent, or Firm*—Richard R. Mybeck

[57] ABSTRACT

A recreational device and method of using same involving the use of player hand to eye coordination to loft a missile toward a remote goal comprising a fabric pouch having a plurality of lesser scoring zones deployed thereabout.

20 Claims, 1 Drawing Sheet

Hot Rocket

RECREATIONAL DEVICE AND METHODS OF USING SAME

INTRODUCTION

The present invention relates to novel recreational devices and methods of using them to develope physical skills while enjoying the exhilaration that occurs in competition between two or more individuals.

BACKGROUND OF THE INVENTION

Many means and methods currently exist which provide recreational activity for a plurality of participants in which each is required to propel a moveable object toward a remote goal subject to an idiosyncratic code of play. Examples of such activities include water polo, basketball, darts, horseshoes, soccer and the like, all of which are rendered distinctly unique by the equipment required and the methods of using the equipment, goal position, opponent's right to defend, player location, and the like.

Each prior game has its devotees as well as its detractors. For the most part, none have gained universal acceptance because each has its own special requirements for players to succeed in competition and hence especially enjoy the particular pastime. Other games of this type are restricted by the area or vertical space required to successfully perform the designated movements. Still others suffer from the onset of player boredom once the minimal skills required to compete successfully have been mastered.

A need thus continues for the presentation of new and interesting recreational devices and methods of using same which are both physically challenging and cerebrally stimulating. It is toward the fulfillment of this need that the present invention is directed.

BRIEF SUMMARY OF INVENTION

The present invention relates to novel and unique recreational devices and methods of using the same to provide enjoyable and challenging activity which can be performed outdoors and indoors.

More particularly, the invention hereof comprises a recreational device for scoring missiles tossed thereof from a distance and having a target assembly including a vertical post member, a loop member, attachment means for securing the loop member to said post member in an outwardly extending relationship therefrom; support means for mounting said post member in a substantially vertical position, identifying means for identifying missiles which pass through said loop member; and scoring means for identifying missiles which do not pass through said loop member but land within a predefined scoring zone adjacent said target assembly.

More particularly, the invention hereof comprises a game device having a base member, a vertical post member mounted in and supported by the base member, a ring member, means for mounting the ring member upon the post member in an outwardly extending relationship therefrom adjacent to the base member in slight superposition thereto; and a pouch member suspended from the ring member and extending downwardly therefrom to receive and contain a missile successfully tossed thereinto by a player standing a preselected distance therefrom. The device hereof further comprises a flexible rope-like member rotatably secured at one end thereof to the post member adjacent the base thereof and includes a visibly distinct demarcation defined substantially midway between its proximal and distal ends for a purpose which shall be herein after described in detail.

Accordingly, a prime object of the present invention is to provide novel and unique means and methods which enable individuals to compete and simultaneously develop useful motor skills while enjoying a recreational activity.

Another object of the present invention is to provide a new and unique recreational device with which competitive interest is maintained despite wide discrepancy in the general skills, ages or size of the competitors.

A further object of the present invention is to provide unique recreational devices having scoring means integrally formed therewith for quickly and easily measuring the relative skills of th competing performers.

Still another object of the present invention is to provide readily transportable recreational devices which can accompany a player to picnic, the beach, the farm and be used wherever a patch of ground can be found.

These and still further objects, as shall hereinafter appear, are fulfilled by the present invention in a remarkably unexpected fashion as will be readily discerned from a careful consideration of the following detailed description of preferred embodiments thereof, especially when read in conjunction with the accompanying drawing in which like parts bear like indicia throughout the several views.

DETAILED DESCRIPTION OF THE PREFERRED EMBODIMENT

Figures 1, 2, 3, 4, 5, 6, 7, 8, 9:
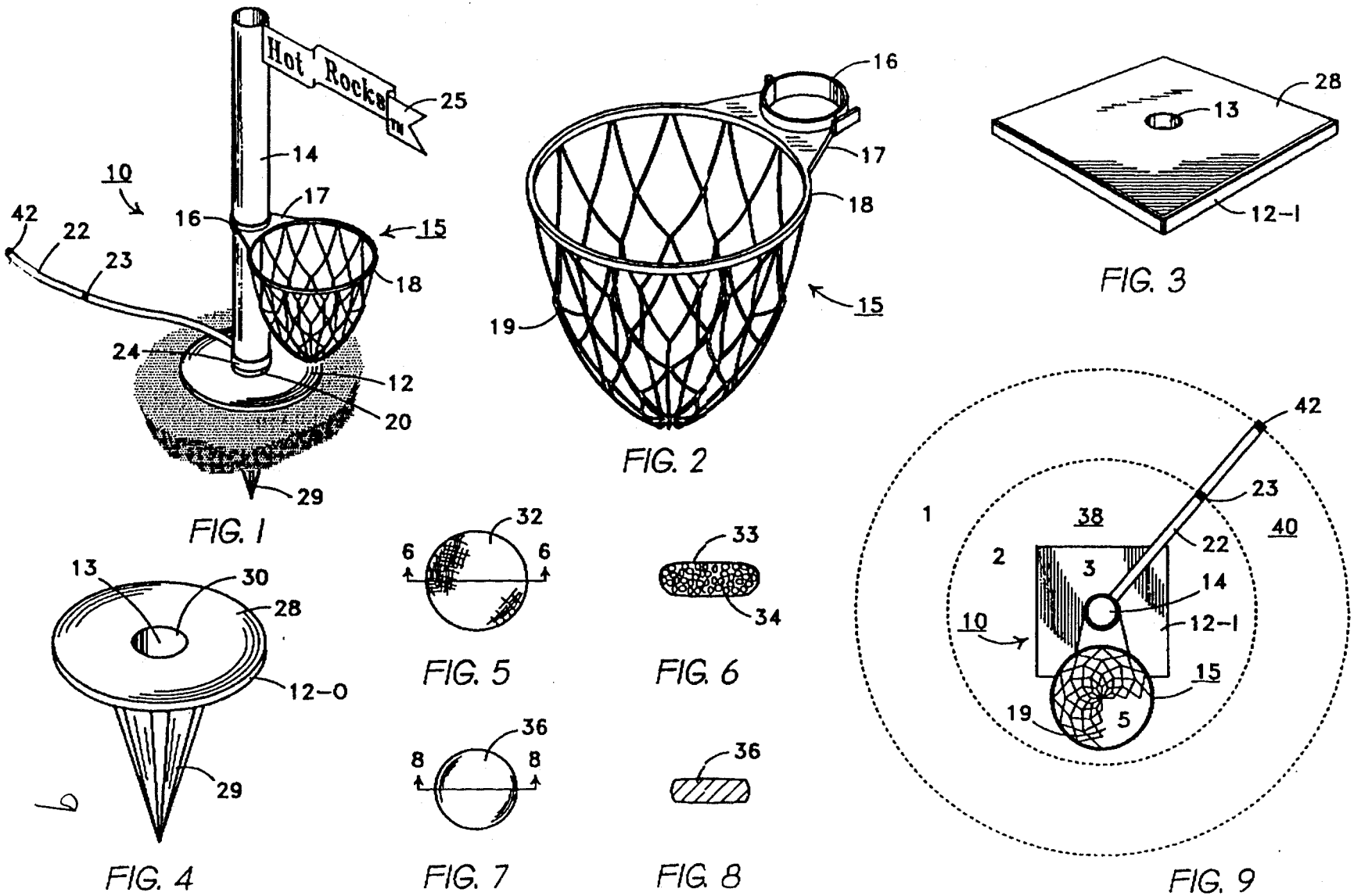
FIG. 1 is an isometric showing of a recreational device embodying the present invention.
FIG. 2 is an isometric view of a target assembly of the recreational device of FIG. 1.
FIG. 3 is an isometric view of a base member for use with the device of FIG. 1 on firm surfaces.
FIG. 4 is an isometric view of an alternate base member for use with the device of FIG. 1 in sand and soft ground.
FIG. 5 is a plan view of one missile for use with the present invention.
FIG. 6 is a cross-section taken on line 6—6 of FIG. 5.
FIG. 7 is a plan view of another missile for use with the present invention.
FIG. 8 is a cross-section taken on line 8—8 of FIG. 7.
FIG. 9 is a plan view of a device embodying the present invention including means and methods of scoring.

The present invention relates to novel recreational devices and methods of using same. More particularly, the invention hereof comprises a recreational device for scoring missiles tossed thereof from a distance and having a target assembly including a vertical post member, a loop member, attachment means for securing the loop member to said post member in an outwardly extending relationship therefrom; support means for mounting said post member in a substantially vertical position, identifying means for identifying missiles which pass through said loop member; and scoring means for identifying missiles which do not pass through said loop member but land within a predefined scoring zone adjacent said target assembly.

In one practice of the present invention, as shown in the drawing, a device embodying the present invention is designated by the general reference 10 and comprises a support means or base member 12 having an opening 13 defined therein for receiving and securing a vertical post member 14 therewithin.

A target assembly 15 is secured to post member 14 in spaced relationship to base member 12 and extends outwardly from post member 14 in generally normal relationship thereto.

Each target assembly 15 comprises attachment means 16 disposable in circumscription about for attachment to post member 14, spacer member 17, a loop member 18 and a depending pouch 19, spacer member 17 being operatively interposed between attachment means 16 and loop 18 to position loop 18 in slight spaced relationship to post member 14. Pouch 19 can be formed of netting or a woven fabric such as polyester and the like and is secured to loop 18 and depends therefrom for purposes to be hereinafter described in detail.

Target assembly 15 preferrably is mounted in a preselected fixed superposed relationship relative to base member 12 but, if desired, can be axially slidable upon and along the length of post member 14 by the provision of an adjustable attachment means 16. Preferably, loop 18 will be positioned from about 5 to about 10 inches above support means 12 so that depending pouch 19 is disposed at its lowermost portion only a few inches above support means 12. Pouch 19 coacts with loop 18 to provide a target for missiles thrown thereat as will hereinafter appear. A flexible rope-like member 22 having a discernible demarcation 23 formed thereon is secured at its proximal end 24 to post member 14 and is extendible radially therefrom and rotatable thereabout for scoring the near misses of missiles thrown toward target assembly 15 as is hereinafter described in detail. A banner 25 is optional and mostly decorative except when device 10 is used at the beach or other windy locations at which time it functions to indicate the direction and gross velocity of th wind.

The present invention is especially designed to enable it to be used either outdoors or indoors at the discretion of the players. A typical outdoor installation is shown in FIG. 1 and a typical indoor installation is shown in FIG. 9. This versatility of use is provided by interchangeable support means 12. The so-called "indoor" support means or base member is identified herein as member 12-I and the so-called "outdoor" or beach support means or base member is identified as 12-0. Each base member 12 comprises a surface plate or platform 28 having opening 13 drilled or otherwise defined therein which opening 13 has a diameter of appropriate size to receive the lower end 20 of post member 14 snugly therewithin.

Base member 12-0, that is, the so-called "outdoor" embodiment of support means 12 for use in sand and other soft earth, comprises a surface-conforming base plate 28 having a conically-shaped pilot means 29 depending therefrom. Central hole or opening 13 is bored or otherwise defined into base plate 28 and the upper portion 30 of pilot means 29 to receive and support post member 14 snugly therewithin.

In a preferred practice of the present invention, both base member 12-I and base member 12-0 are fabricated of a dense plastic or wood material and device 10 is assembled as follows. The lower end 20 of post member 14 is telescopically inserted into opening 13 in support means 12 until it will enter no further. The base member, for example 12-I, is placed on the ground or other surface such as a floor or patio, in such a manner that post member 14 extends truly vertical therefrom. A like base member 12-I is similarly placed a preselected distance from the first base member 12. When used on soft earth or sand out of doors, inverted conical pilot member 29 is inserted or driven into the soil or sand until the upper portion 30 enters into and engages the ground or sand. Post member 14 is then telescopically inserted into hole 13 as far as it will go to secure post member 14 therein and to stabilize post member 14 in vertical relationship to the ground. As shown in FIG. 4, the pilot portion 29 of outdoor base member 12-0 tapers to a point which allows it to be driven into the ground to provide a stable means for device 10 when desired.

The preferred missiles for use with the present invention are shown in FIGS. 5–8. One, missile 32, is specially designed for indoor use and, as shown in FIGS. 5 and 6, comprises a woven bag 33 having a plurality of plastic pellets or beads 34 disposed therein and secured thereby.

When tossed towards the target, indoor missile 32 produces a trajectory similar to that of a bean bag. Missile 32 will not, upon landing, bounce and damage to nearby items is avoided. Further because of its firm landing caused by its flaccid nature a more accurate scoring of near misses is obtained.

The preferred embodiment for the outdoor missile 36 is shown in FIGS. 7 and 8, and comprises a hard puck-like plastic disk of about 2 inches in diameter and aerodynamically designed to minimize wind resistance when tossed at the target. Such a design allows for greater accuracy as the distance between the launch line and the goal is expanded. Because it is employed on sand or soft ground, the bounce of outdoor missile is minimized and the accuracy of scoring near misses is reasonably enhanced.

One method of scoring a game played with device 10 is illustrated in FIG. 9. For purposes of this description an indoor installation of device 10 is shown although the principal of scoring to be described is equally applicable to an outdoor installation.

In play, a suitable missile such as missile 32 can obtain any of several possible landing sites when it is tossed at target assembly 15 and more particularly at the center of loop 18 from a distance. A pouch 19, preferably depended from loop 18, provides ready means to receive and retain and thereby identify each missile 32 which successfully passes through loop 18 while platform 12-I and its surrounding area will receive and permit ready identification of near misses. Thus when missile 32 passes through loop 18 into pouch 19, the launcher thereof will receive a premium number of points, e.g., 5, for his/her effort. If the loop 18 is missed but all or any part of the missile 32 lands on base plate 28, a lesser number of points, e.g., 3, are awarded. When missile 32 misses loop 18 and lands outside the area of base plate 28 but within the area of a circle 38 defined within a radius defined between post member 14 and mark 23 on flexible rope 22, (less the area of the base plate 28), a fewer number of points, e.g., 2, are awarded. Still less points, e.g., 1, are awarded when the missile 32 lands in the annulus 40, defined between the distal end 42 of rope 22 and mark 23 defined therein when rope 22 is rotated about post 14. Missiles 32 which land in no defined scoring area that is, outside of annulus 40 will receive no points at all. When the flaccid missile 32 is used, the missile 32 will stay where it lands without rolling or bouncing.

As will appear, device 10 will usually be deployed in pairs and in use provides a skill game for youngsters of all ages from five to seventy-five five or more. In use, a pair of devices 10 will be spaced from about 5 to about 8 steps apart, for example, from about 10 to about 16 feet apart, for younger children, and from about 8 to about 10 or more steps apart for adults. In practice, the player or team to first reach a preestablished point level, such as twenty-one points, is declared the winner. Any number of players, but preferably from two to four persons can participate in a game at the same time and each will be permitted to launch one or two missiles on each turn to toss. Flexible rope 22, as described, provides means to determine scoring in accordance with preselected values as previously described. A coin flip or like method of chance can be employed to determine who goes first. In practice, the opponents will alternate shots, from the same launching line until all of the missiles have been thrown at the target goal. When desired, the team that wins the first match will throw first in the succeeding match.

In one variation, only the player whose missile lands in or closest to the target assembly will be awarded points. If both rivals place their best shot in the target assembly pouch or on a spot equidistance from post member 14 on the same round, neither team will score. A further variation involves scoring points for all missiles which land within a designated scoring area. Of course, other scoring schemes may be developed among the players when desired.

In one practice of the present invention, each player will position himself adjacent one of the devices installed on a launching line and will attack the other target assembly by attempting to toss his/her missiles, one at a time, from the predefined launching line into or near the target assembly mounted on the other device. Two different missiles are included for use herewith. The first comprises a hard plastic "puck-shaped" member which is preferred for outdoor/beach use. The second missile comprises a cloth bag filled with a plurality of plastic beads and is preferred for indoor use or wherever use of the hard missile could damage the surroundings.

From the foregoing, it can be readily ascertained that a new and useful recreational device has been herein described and illustrated which fulfills all the foregoing objectives in a remarkably unexpected fashion. It is, of course, understood that such modifications, alterations and adaptations, as may readily occur to the artisan confronted with this disclosure, are intended within the spirit of the present invention which is limited solely by the scope of the claims appended hereto.

Accordingly what is claimed is,

1. A recreational device comprising: a plurality of missiles distinguishable as to origin; a target assembly including a post member, a loop member, attachment means for securing said loop member to said post member and holding said loop member in a fixed horizontal plane a spaced preselected distance from said post member, support means for mounting said post member in a substantially vertical position, identifying means for identifying the source of said missiles which pass through said loop member; and scoring means for identifying the source of said missiles which do not pass through said loop member but land within predefined scoring zones disposed adjacent to and in circumscription about said target assembly.

2. A recreational device according to claim 1 in which said missiles are tossed from a preselected fixed distance at said target assembly.

3. A recreational device according to claim 2 in which said missiles are flaccid.

4. A recreational device according to claim 1 in which said support means comprises a platform, means to attach said post member to said platform and means to secure said platform to the ground.

5. A recreational device according to claim 2 in which siad support means comprises a platform, means to attach said post member to said platform, and means to secure said platform to the ground.

6. A recreational device according to claim 3 in which said support means comprises a platform means to attach said post member to said platform, and to secure said platform to the ground.

7. A recreational device according to claim 4 in which said support means includes a pointed member extending downwardly from said platform and adapted to penetrate into the earth.

8. A recreational device according to claim 5 in which said support means includes a pointed member extending downwardly from said platform and adapted to penetrate into the earth.

9. A recreational device according to claim 6 in which said support means includes a pointed member extending downwardly from said platform and adapted to penetrate into the earth

10. A recreational device according to claim 1 in which said identifying means comprises a pouch secured to and depending from said loop.

11. A recreational device according to claim 2 in which said identifying means comprises a pouch secured to and depending from said loop.

12. A recreational device according to claim 3 in which said identifying means comprises a pouch secured to and depending from said loop.

13. A recreational device according to claim 4 in which said identifying means comprises a pouch secured to and depending from said loop.

14. A recreational device according to claim 7 in which said identifying means comprises a pouch secured to and depending from said loop.

15. A recreational device for receiving and scoring a plurality of missiles distinguishable as to origin tossed thereat from a fixed preselected distance comprising: a base member; a post member mounted to said base member and extending vertically therefrom; a goal member attached to said post member in fixed spaced relationship thereto, and extending outwardly therefrom in generally normal relationship thereto, said goal member having an enclosed pouch depending therefrom for receiving and containing missiles tossed thereinto; and scoring means for identifying the source of said missiles which do not pass through the loop member but land within predefined scoring zones disposed adjacent to and in circumscription about said target assembly.

16. A recreational device according to claim 15 in which said base member includes a base plate and post receiving means defined in said base plate and coactive therewith to secure said post means thereto.

17. A competitive recreational device for receiving missiles tossed thereat from a distance comprising: a base member; a post member mounted to said base member and extending vertically therefrom; a goal member attached to said postmember and extending outwardly therefrom in generally normal relationship thereto; said goal member having an enclosed pouch therein for receiving and containing missiles tossed thereinto by a competitor disposed a preselected fixed distance therefrom; said base member having a post receiving means defined therein and pointed pilot means integrally formed with said base plate and depending therefrom.

18. A recreational device according to claim 17 in which siad goal member includes securing means for adjustably attaching said goal member to said post member.

19. A recreational device according to claim 17 having flexible means secured to said post member and rotatable thereabout to evaluate the accuracy of a missile tossed at said goal member.

20. A recreational device according to claim 17 in which said missile comprises a fabric envelope and a plurality of plastic beads disposed therewithin.

* * * * *